US005538144A

United States Patent [19]

Reed

[11] Patent Number: 5,538,144

[45] Date of Patent: Jul. 23, 1996

[54] HAT HANGER AND DISPLAY DEVICE

[76] Inventor: Scott W. Reed, 6594 S. Piney Creek Cir., Aurora, Colo. 80016

[21] Appl. No.: 270,445

[22] Filed: Jul. 5, 1994

[51] Int. Cl.[6] ..... A47F 7/00

[52] U.S. Cl. ..... 211/32; 211/87; 248/309.1; 248/300

[58] Field of Search ..... 211/30, 32, 33, 211/87, 35; 248/309.1, 300

[56] References Cited

U.S. PATENT DOCUMENTS

| | | | |
|---|---|---|---|
| 874,014 | 12/1907 | Kurtzon | 211/87 X |
| 939,815 | 11/1909 | Dumond | 211/87 X |
| 1,358,322 | 11/1920 | McIntosh | 248/300 |
| 1,416,823 | 5/1922 | Hecht | 211/35 X |
| 1,688,004 | 10/1928 | De Karske | 211/35 |
| 3,208,597 | 9/1965 | Hansen | 211/32 |
| 3,278,148 | 10/1966 | Denaro | 248/300 X |
| 3,722,843 | 3/1973 | Euckler | 248/309.1 X |
| 5,002,190 | 3/1991 | Moreland | 211/32 |
| 5,303,829 | 4/1994 | Kennedy | 211/32 X |

*Primary Examiner*—Robert W. Gibson, Jr.
*Attorney, Agent, or Firm*—Michael I. Kroll

[57] ABSTRACT

A hat hanger and display device comprising a member for supporting a crown of a hat. An assembly is for mounting the supporting member to a vertical flat surface, so that the crown of the hat can be displayed therefrom.

4 Claims, 2 Drawing Sheets

HAT HANGER AND DISPLAY DEVICE

BACKGROUND OF THE INVENTION

1. Field of the Invention

The instant invention is the subject matter of Disclosure Document No.: 349715 filed in the PTO on Mar. 8, 1994, and it is respectfully requested that this document be retained beyond the two-year period so that it may be relied upon as evidence of conception of the invention during the prosecution phase of this application, should the need arise.

The instant invention relates generally to hat racks and more specifically it relates to a hat hanger and display device.

2. Description of the Prior Art

Numerous hat racks have been provided in prior art that are adapted to hold various hats therein. While these units may be suitable for the particular purpose to which they address, they would not be as suitable for the purposes of the present invention as heretofore described.

SUMMARY OF THE INVENTION

A primary object of the present invention is to provide a hat hanger and display device that will overcome the shortcomings of the prior art devices.

Another object is to provide a hat hanger and display device that is practically undetectable when mounted to a vertical flat surface with a hat in place thereon, so that in some instance a logo on the hat can be properly displayed therefrom.

An additional object is to provide a hat hanger and display device that can hold different types of hats in the best possible shape.

A further object is to provide a hat hanger and display device that is simple and easy to use.

A still further object is to provide a hat hanger and display device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
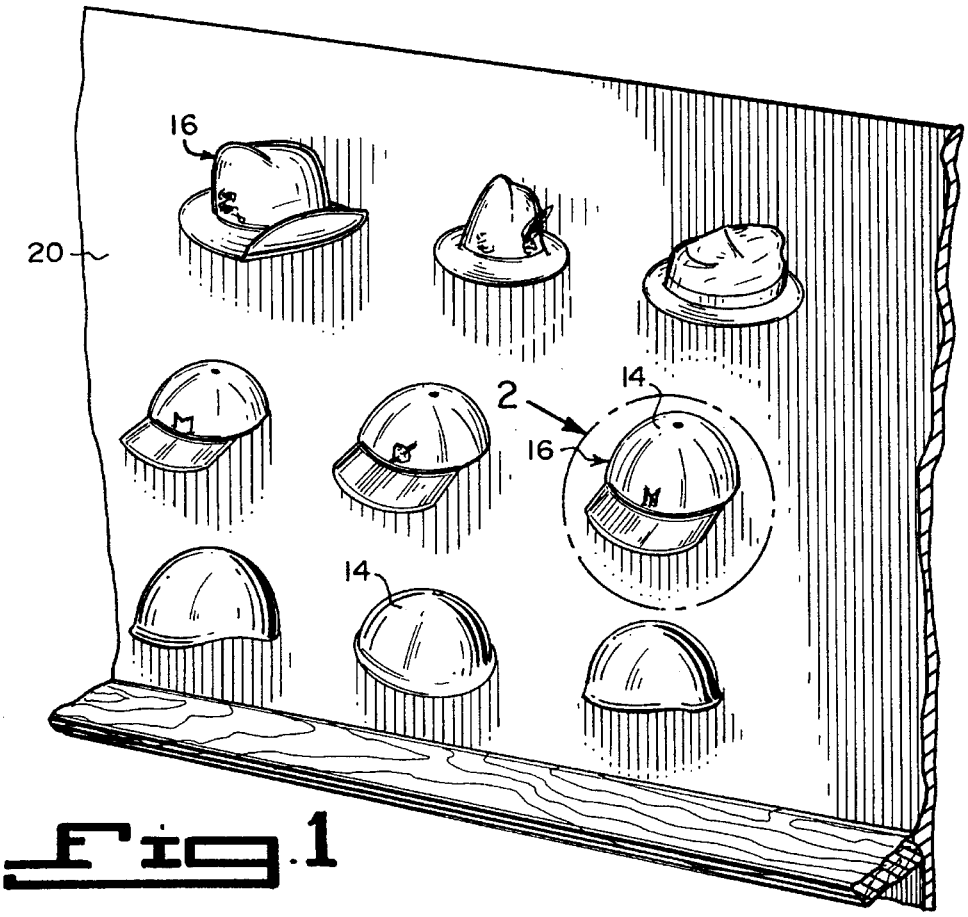
FIG. 1 is a right side perspective view showing different types of hats that are each supported by the instant invention, which is mounted to a vertical flat surface.

Turning now descriptively to the drawings, in which similar reference characters denote similar elements throughout the several views, FIGS. 1 through 6 illustrate a hat hanger and display device 10 comprising a member 12, for supporting a crown 14 of a hat 16. An assembly 18 is for mounting the supporting member 12 to a vertical flat surface 20, so that the crown 14 of the hat 16 can be displayed therefrom.

The mounting assembly 18 includes an upright arm 22 to be placed against the vertical flat surface 20. A plurality of fasteners 24 are for attaching the upright arm 22 to the vertical flat surface 20.

Each fastener 24 is a screw 26, that extends through the upright arm 22 and into the vertical flat surface 20. The upright arm 22 is a rectangular shaped blade member 28.

The supporting member 12 consists of a brace structure 30 extending from the bottom end of the upright arm 22. A tab 32 extends from a top surface of the brace structure 30 near to and parallel with the upright arm 22 and could be perpendicular to the brace structure 30. The back of the crown 14 can hook onto the tab 32 with the brace structure 30 extending across the underside of the crown 14.

Figure 2:
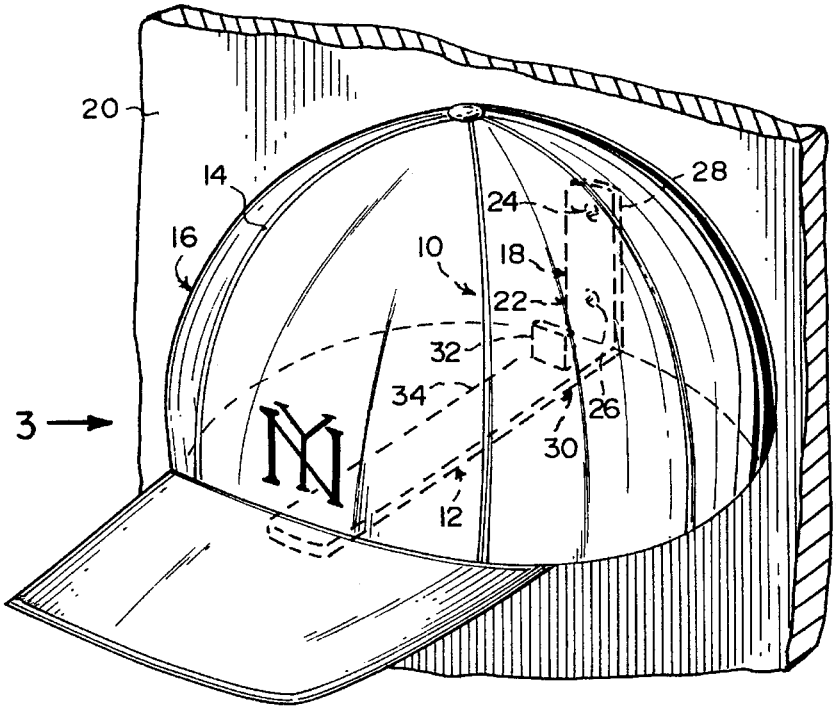
FIG. 2 is an enlarged right side perspective view as indicated by arrow 2 in FIG. 1, showing a first embodiment of the instant invention in dotted lines.
Figure 3:
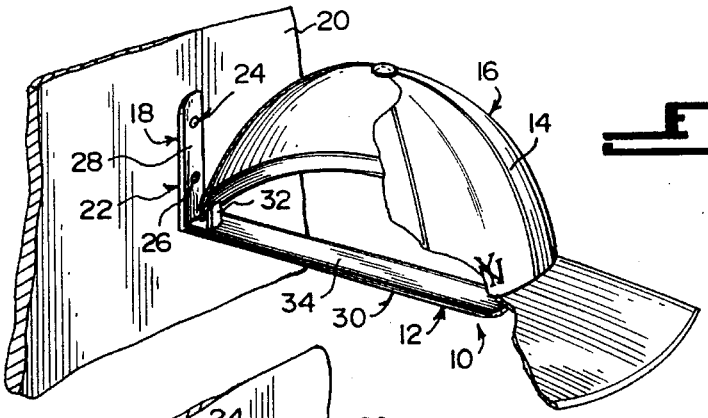
FIG. 3 is a left side perspective view of the first embodiment taken in the direction of arrow 3 in FIG. 2, with the crown and bill of the hat broken away.
Figure 4:
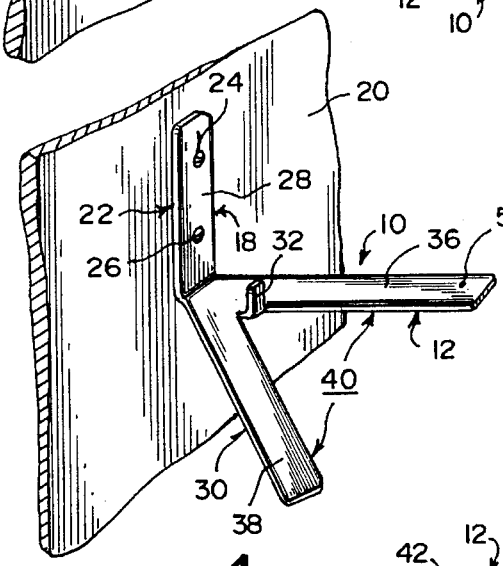
FIG. 4 is a left side perspective view similar to FIG. 3, of a second embodiment of the instant invention without a hat.

As best seen in FIGS. 2 and 3, the brace structure 30 is a diagonal arm 34, extending at a slight angle downwardly from the upright arm 22. The brace structure 30 in FIG. 4, is a pair of diagonal arms 36, 38 extending at a slight angle downwardly from the upright arm 22 in a V-shaped configuration 40. The brace structure 30 in FIG. 5 is a pair of diagonal arms 42, 44, extending at a slight angle downwardly from the upright arm 22 in a Y-shaped configuration 46.

Figure 5:
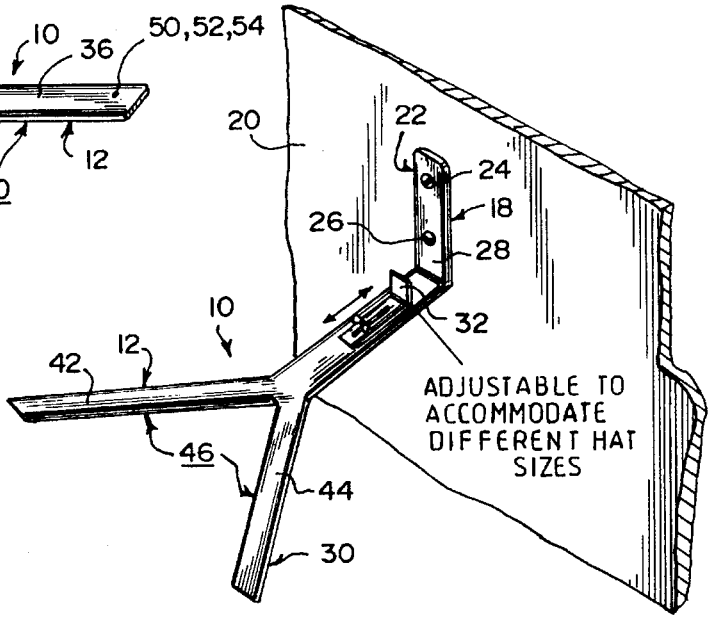
FIG. 5 is a right side perspective view similar to FIG. 2 of a third embodiment of the instant invention without a hat.
Figure 6:
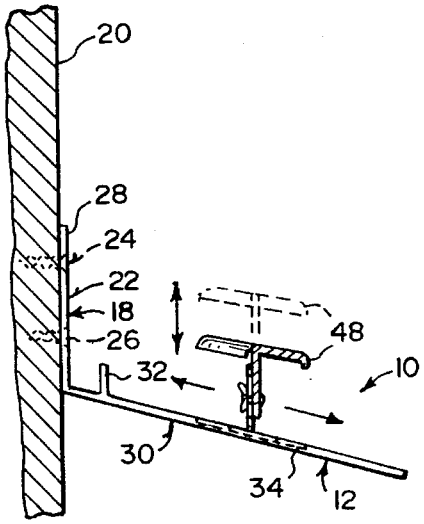
FIG. 6 is a left side view with parts shown in cross section of a fourth embodiment of the instant invention without a hat.

The tab 32, as shown in FIG. 5, can be width adjustable to accommodate hats 16 of different sizes. A height and width adjustable umbrella shaped support 48, as shown in FIG. 6, is on the diagonal arm 34, to better maintain the crown 14 of the hat 16 for display purposes.

The hat hanger and display device 10 can be fabricated out of plastic material 50, wood material 52 or metal material 54.

The vertical flat surface 20 can be a wall, a plate, a panel or a plaque. The hat hanger and display device 10 can be painted to match the decor of any room that it is used in. The hat hanger and display device 10 can be mounted anywhere and when used in multiples, can be placed in any desired pattern, as shown in FIG. 1, to hold different types of hats 16.

The upstanding arm 22 could be made in different shapes, such as team logos to conform to the logos on the hats 16. The hat hanger and display device 10 could also be made to be a self-standing unit on a horizontal flat surface. A triangle wedge could be used when mounting the hat hanger and display device 10 in a corner of a room.

The diagonal arm 34 in FIGS. 2 and 3, the diagonal arms 36 and 38 in FIG. 4 and the diagonal arms 42 and 44 in FIG. 5 could also be horizontal with respect to the upright arm 22. The brace structure 30 in all instances will still extend across the underside of the crown 14 of the hat 16.

The typical sizes of the various components of the hat hanger and display device 10 are as follows:

1. Diagonal arm 34—ten inches by two inches.
2. Tab 32—one inch by one inch.
3. Upstanding arm 22—three inches by two inches.

LIST OF REFERENCE NUMBERS

10 hat hanger and display device
12 supporting member
14 crown of 16
16 hat
18 mounting assembly
20 vertical flat surface
22 upright arm
24 fastener
26 screw for 24
28 rectangular shaped blade member for 22
30 brace structure
32 tab on 30
34 diagonal arm for 30
36 diagonal arm for 30
38 diagonal arm for 30
40 V-shaped configuration for 36, 38
42 diagonal arm for 30
44 diagonal arm for 30
46 Y-shaped configuration for 42, 44
48 umbrella shaped support on 34
50 plastic material for 10
52 wood material for 10
54 metal material for 10

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hat hanger and display device comprising:

a) means for supporting a crown of a hat; and b) means for mounting said supporting means to a vertical flat surface, so that the crown of the hat can be displayed therefrom, said mounting means including an upright arm to be placed against the vertical flat surface, and a plurality of fasteners for attaching said upright arm to the vertical flat surface, each said fastener being a screw that extends through said upright arm and into the vertical flat surface, said upright arm being a rectangular shaped blade member, said supporting means including a brace structure extending from the bottom end of said upright arm, and a tab extending from a top surface of said brace structure near to and parallel with said upright arm and are perpendicular to said brace structure, so that the back of the crown can hook onto said tab with said brace structure extending across the underside of said crown, said brace structure being a pair of diagonal arms extending at a slight angle downwardly from said upright arm in a Y-shaped configuration, said tab being width adjustable to accommodate hats of different sizes.

2. A hat hanger and display device as recited in claim 1, that is fabricated out of plastic material.

3. A hat hanger and display device as recited in claim 1, that is fabricated out of wood material.

4. A hat hanger and display device as recited in claim 1, that is fabricated out of metal material.

* * * * *